US009924801B1

(12) United States Patent
Green, Sr.

(10) Patent No.: US 9,924,801 B1
(45) Date of Patent: Mar. 27, 2018

(54) INFLATABLE LOUNGE CHAIR WITH WATER MISTING SYSTEM

(71) Applicant: Kenneth M. Green, Sr., Enid, OK (US)

(72) Inventor: Kenneth M. Green, Sr., Enid, OK (US)

( * ) Notice: Subject to any disclaimer, the term of this patent is extended or adjusted under 35 U.S.C. 154(b) by 106 days.

(21) Appl. No.: 15/215,681

(22) Filed: Jul. 21, 2016

Related U.S. Application Data

(60) Provisional application No. 62/195,583, filed on Jul. 22, 2015.

(51) Int. Cl.

| | |
|---|---|
| ***B63C 9/30*** | (2006.01) |
| ***A47C 4/54*** | (2006.01) |
| ***A47C 7/74*** | (2006.01) |
| ***A47C 15/00*** | (2006.01) |
| ***A47C 1/14*** | (2006.01) |

(52) U.S. Cl.
CPC ..... *A47C 15/006* (2013.01); *A47C 1/143* (2013.01); *A47C 1/146* (2013.01); *A47C 4/54* (2013.01); *A47C 7/744* (2013.01); *B63C 9/30* (2013.01)

(58) Field of Classification Search
CPC .. B63C 9/30; A47C 1/14; A47C 1/143; A47C 1/146; A47C 4/54; A47C 7/74; A47C 7/742; A47C 7/744; A47C 15/006
See application file for complete search history.

(56) References Cited

U.S. PATENT DOCUMENTS

| | | | | |
|---|---|---|---|---|
| 4,141,585 | A | 2/1979 | Blackman | |
| 4,986,781 | A * | 1/1991 | Smith | A47C 15/006 4/541.3 |
| 5,004,296 | A * | 4/1991 | Ziegenfuss, Jr. | A47C 15/006 297/188.14 |
| 5,156,339 | A | 10/1992 | Gibson et al. | |
| 5,233,705 | A | 8/1993 | Coleman et al. | |
| 5,722,596 | A | 3/1998 | Dome | |
| 5,951,111 | A | 9/1999 | Klimenko | |
| 5,984,744 | A | 11/1999 | Lutz | |
| 6,746,293 | B1 | 6/2004 | Kirby, Jr. et al. | |
| 7,077,465 | B1 * | 7/2006 | Calderon | A47C 1/14 297/180.15 |
| 8,123,291 | B1 | 2/2012 | Hernandez | |
| 9,351,581 | B1 * | 5/2016 | Sawyer | A47C 1/143 |

* cited by examiner

*Primary Examiner* — Ajay Vasudeva
(74) *Attorney, Agent, or Firm* — Robert C. Montgomery; Montgomery Patent & Design, LP

(57) ABSTRACT

An inflatable lounge chair with an integrated water misting system includes a chair configured to float on water, and a misting system integrated within the chair, wherein the misting system is configured to draw the water upon which the chair floats and dispense misting water onto the chair.

6 Claims, 2 Drawing Sheets

INFLATABLE LOUNGE CHAIR WITH WATER MISTING SYSTEM

RELATED APPLICATIONS

The present invention claims the benefit of U.S. Provisional Application No. 62/195,583 filed on Jul. 22, 2015, the entire disclosures of which are incorporated herein by reference.

FIELD OF THE INVENTION

The present invention relates generally to lounge chairs and, more particularly, to an inflatable floating lounge chair that includes an integral water misting system.

BACKGROUND OF THE INVENTION

Very few leisure time activities rival that of spending a warm summer day in or around a swimming pool or other body of water. Many people enjoy floating on an inflatable lounge chair while in the water. These chairs allow the user to relax, be close to the water, tan, and perhaps even take a nap. However, as the user lies upon the chair, it is quite common to become hot and suffer from dry skin. Therefore, many users quickly take a dip in the water to combat such conditions. However, should the user be relaxing or even sleeping, such interruptions are burdensome. Moreover, many people have difficulty getting back on the floating chair in the middle of water, thus, forcing a trip back to the shore or the side of the pool further interrupting their relaxation.

Accordingly, there exists a need for a means by which the user of an inflatable pool lounge chair can remain cool while remaining in the comfort of the chair.

SUMMARY OF THE INVENTION

The inventor has recognized the aforementioned inherent problems and lack in the art and observed that there is a need for an inflatable lounge chair with integrated water misting system. The development of the present invention, which will be described in greater detail herein, fulfills this need.

In one (1) embodiment, the disclosed apparatus includes a chair configured to float on water, and a misting system integrated within the chair, wherein the misting system is configured to draw the water upon which the chair floats and dispense misting water.

In another embodiment, the disclosed apparatus includes a lounge chair that includes an inflatable body configured to float on water and having a seat, a back, and arm rests, and a misting system that includes a first pump disposed within the seat, wherein the first pump includes a first pump intake disposed on an exterior of a bottom surface of the seat in fluid communication with the water upon which the chair floats, a plurality of first misting ports formed in the seat and fluidly connected to the first pump, wherein the plurality of first misting ports dispense misting water onto the seat, a second pump disposed within the seat, wherein the second pump includes a second pump intake disposed on the exterior of the bottom surface of the seat in fluid communication with the water, a plurality of second misting ports formed in the back and fluidly connected to the second pump, wherein the plurality of second misting ports dispense the misting water onto the back, a power supply in electrical communication with the first pump and the second pump, a first switch electrically interconnected between the power supply and the first pump, and a second switch electrically interconnected between the power supply and the second pump.

Furthermore, the described features and advantages of the disclosure may be combined in various manners and embodiments as one skilled in the relevant art will recognize. The disclosure can be practiced without one or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
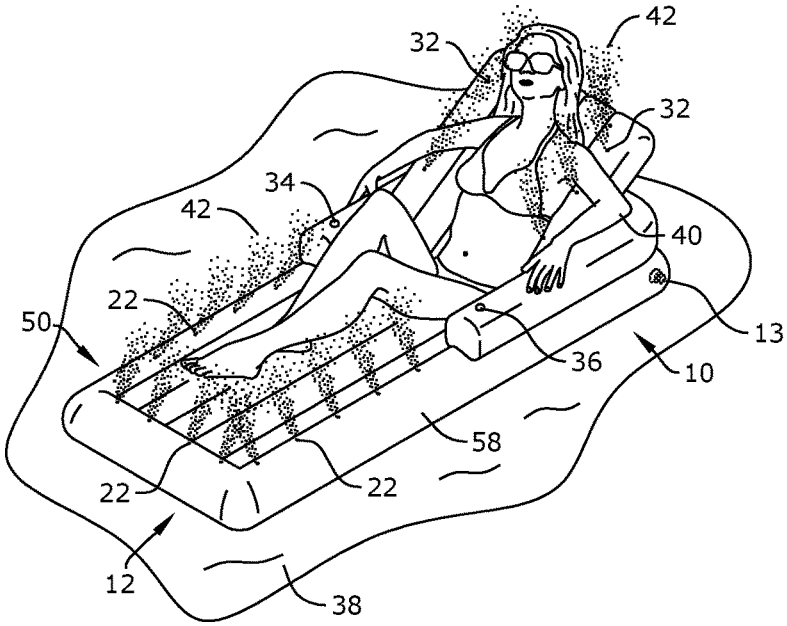
FIG. 1 is an environmental perspective view of an inflatable lounge chair with an integrated water misting system, according to a preferred embodiment of the present invention.

10 inflatable lounge chair with an integrated water misting system
12 lounge chair
13 inflation port
14 first pump
16 first pump intake
18 first feed tube
20 first misting tube
22 first misting port
24 second pump
26 second pump intake
28 second feed tube
30 second misting tube
32 second misting port
34 first switch
36 second switch
38 water
40 occupant
42 misting water
44 seat
46 back
48 arm rest
50 misting system
52 power supply
54 charging port
56 air chamber
58 inflatable body

DETAILED DESCRIPTION OF THE PREFERRED EMBODIMENT

FIGS. 1-4 disclose an inflatable lounge chair with an integrated water misting system, generally identified herein as an apparatus, 10, where like reference numerals represent similar or like parts. Generally, the apparatus 10 includes a floating, inflatable lounge chair 12 having an integral misting system 50.

Figure 2:
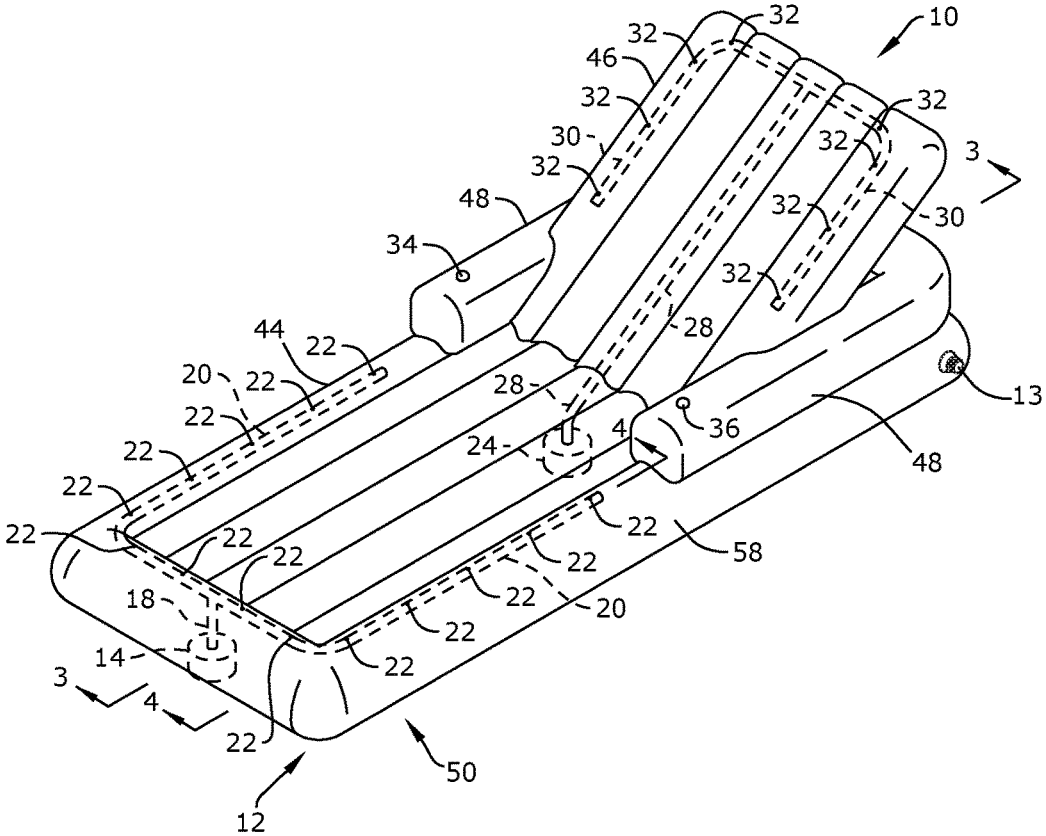
FIG. 2 is a perspective view of the inflatable lounge chair with an integrated water misting system, according to a preferred embodiment of the present invention.

FIG. 1 is an environmental perspective view of the disclosed apparatus 10 and FIG. 2 is a perspective view of the disclosed apparatus 10, according to a preferred embodiment. The apparatus 10 includes a lounge chair 12, for example, for use in a pool or on the lake. The chair 12 includes an inflatable body 58. In an example construction, the inflatable body 58 of the chair 12 is made of plastic, such as vinyl. In other example constructions, other suitable materials may also be used. The apparatus 10 is suitably sized to accommodate at least one adult person. As an example, the apparatus 10 is approximately six feet (6 ft.) long, two-and-a-half feet (2½ ft.) wide, and six inches (6 in.) thick.

Referring to FIGS. 1 and 2, in an example embodiment, the chair 12 includes a seat 44, an upstanding back 46, and a pair of arm rests 48 extending upwardly from a top surface of the seat 44. In an example construction, the chair 12 is made of a thin plastic sheet. For example, various panels of plastic sheeting may be heat-sealed along mutually engaging edges to form one or more internal air chambers 56 (see FIG. 3) of the inflatable body 58. The apparatus 10 also includes at least one inflation port 13 formed in the chair 12 for accessing the internal air chamber 56 and capable of enabling air to fill (i.e., inflate) and escape from (i.e., deflate) the inflatable body 58 of the chair 12 to provide for the flotation characteristics.

Referring still to FIGS. 1 and 2, the apparatus 10 also includes a plurality of misting ports formed in the chair 12. As an example, the apparatus 10 includes a plurality of first misting ports 22 formed in the seat 44 and a plurality of second misting ports 32 formed in the back 46. For example, the plurality of first misting ports 22 may be located along an outer perimeter of the top surface of the seat 44 and the plurality of second misting ports 32 may be located along an outer perimeter of a top surface of the back 46.

Referring to FIG. 1, the first misting ports 22 and second misting ports 32 direct water onto a top surface of the chair 12 and, thus, also onto an occupant 40 of the chair 12. The water is drawn from the body of water 38 (e.g., a pool, a lake, an ocean, etc.) upon which the apparatus 10 floats. The apparatus 10 also includes at least one (1) pump configured to draw the water from the body of water 38 and dispense the water out from the first misting ports 22 and second misting ports 32.

Referring to FIG. 2, in an example embodiment, the apparatus 10 includes a first pump 14 and a second pump 24. The first pump 14 is fluidly connected to the first misting ports 22 via flexible first misting tubing 20. The second pump 24 is fluidly connected to the second misting ports 32 via flexible second misting tubing 30.

Figure 3:
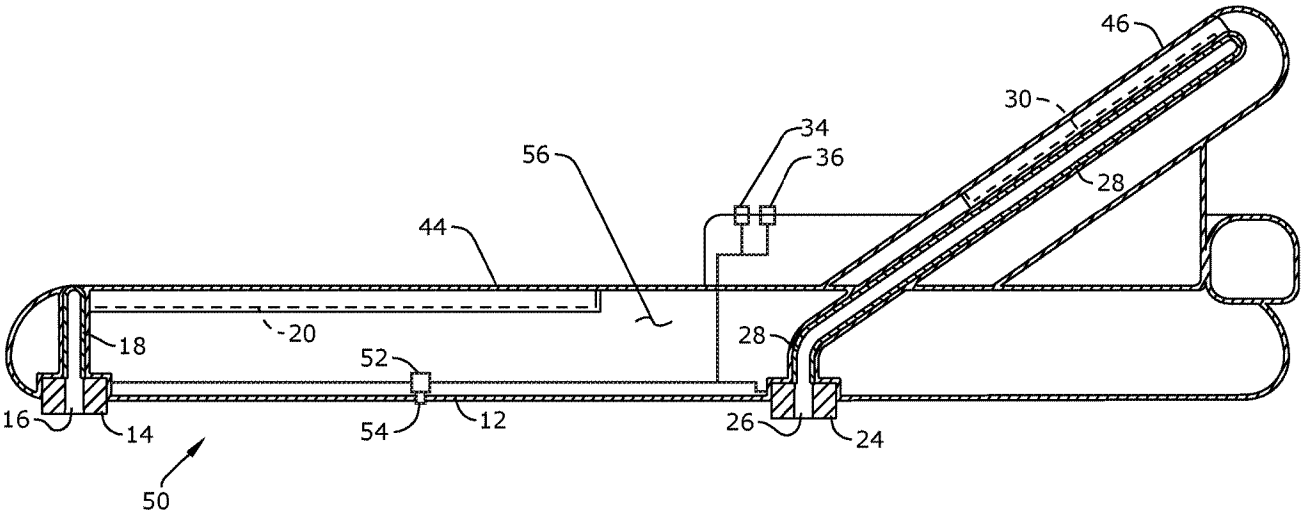
FIG. 3 is a sectional side elevation view taken along line 3-3 of FIG. 2 of the inflatable lounge chair with an integrated water misting system, according to a preferred embodiment of the present invention; and, FIG. 4 is a partial sectional side elevation view taken along line 4-4 of FIG. 2 of the inflatable lounge chair with an integrated water misting system, according to a preferred embodiment of the present invention.
Figure 4:
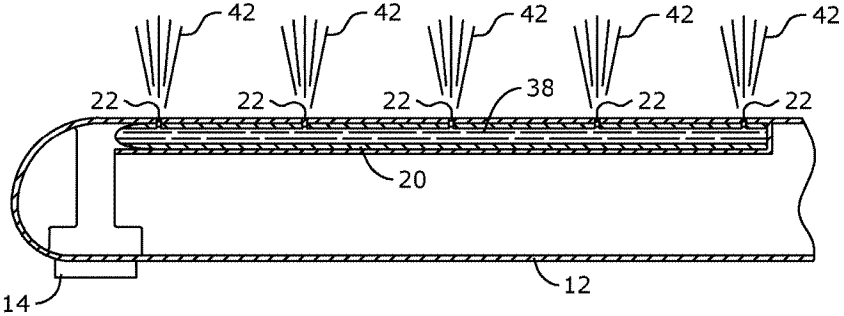

FIG. 3 is a side elevation view, in section, of the apparatus 10 and FIG. 4 is a partial side elevation view, in section, of the apparatus 10, according to a preferred embodiment. In an example construction, the first pump 14 extends downward from a front bottom portion of the chair 12 such that a first pump intake 16 is in fluid communication with the water 38 (see FIG. 1). The second pump 24 extends downward from a rear bottom portion of the chair 12, for example, at or near the back 46, such that a second pump intake 26 is in fluid communication with the water 38. The first pump 14 is located within the air chamber 56 of the chair 12, for example, the portion of the air chamber 56 forming the seat 44. The first pump intake 16 extends from a bottom surface of the seat 44 for contact with the water 38. The second pump 24 is also located within the air chamber 56 of the chair 12, for example, the portion of the air chamber 56 forming the seat 44. The second pump intake 26 extends from the bottom surface of the seat 44 for contact with the water 38.

Referring still to FIG. 3, the first pump 14 and the second pump 24 receive power from a power supply 52. In an example, the power supply 52 is located within the air chamber 56 of the chair 12, for example, the portion of the air chamber 56 forming the seat 44. In the example of an internal power supply 52, the power supply 52 may include a rechargeable battery. In such an example, the apparatus 10 also includes a charging port 54 in electrical communication with the power supply 52 for recharging. The charging port 54 may be located on an exterior of the chair 12. The charging port 54 also includes a waterproof cover (not shown).

In another example (not shown), the power supply 52 is located on the exterior of the chair 12. As an example, the external power supply 52 may include a 3-volt battery pack using user-replaceable batteries. In the example of an external power supply 52, the battery pack may be enclosed within a waterproof housing (not shown).

Referring to FIG. 3, the first pump 14 is controlled by a first switch 34 and the second pump 24 is controlled by a second switch 36. Each of the first switch 34 and the second switch 36 includes an actuator (not shown), such as a push button switch, located on the exterior of the chair 12. The first switch 34 is in electrical communication between the power supply 52 and the first pump 14, which it activates. Similarly, the second switch 36 is in electrical communication between the power supply 52 and the second pump 24, which it activates.

Referring again to FIG. 2, in the illustrated example, the first switch 34 and the second switch 36 are located on the arm rests 48 of the chair 12. In the illustrated example, the first switch 34 may be located on the right arm rest 48 of the chair 12 and the second switch 36 may be located on the left arm rest 48 of the chair 12. In other examples, the position of the first switch 34 and/or the second switch 36 may be at any other advantageous and conveniently accessible location on the exterior of the chair 12.

Referring to FIGS. 2 and 3, the first misting tube 20 is a manifold routed through channels within the interior chamber 56 of the chair 12 towards the front and along the front sides of the chair 12 near the top surface of the chair 12. In an example construction, the first misting tube 20 is routed through the horizontal seat 44 of the chair 12. The first misting tube 20 has an inlet in fluid communication with an outlet of the first feed tube 18. An inlet of the first feed tube 18 is in fluid communication with an outlet of the first pump 14. Thus, actuation of the first switch 34 activates the first pump 14, which draws the water 38 upon which the chair 12 floats and transfers the water 38 through the first feed tube 18 and the first misting tube 20, and dispenses the water 38 out of each of the first misting ports 22 as misting water 42 (see FIG. 1).

Similarly, the second misting tube 30 is a manifold routed through channels within the interior chamber 56 of chair 12 towards the rear and along the rear sides near the top surface of the chair 12. In an example construction, the second misting tube 30 is routed through the upstanding back 46 of the chair 12. The second misting tube 30 has an inlet in fluid communication with an outlet of the second feed tube 28. An inlet of the second feed tube 28 is in fluid communication with an outlet of the second pump 24. Thus, actuation of the second switch 36 activated the second pump 24, which draws the water 38 upon which the chair floats and transfers the water 38 through the second feed tube 28 and the second misting tube 30, and dispenses the water 38 out of each of the second misting ports 32 as misting water 42 (see FIG. 1).

The first feed tube 18, the first misting tube 20, the second feed tube 28, and the second misting tube 30 are flexible to allow the chair 12 to be deflated and stored as needed.

During use of the apparatus 10, the first pump 14 and/or the second pump 24 can be turned on and off as needed or left off completely allowing the apparatus 10 to function as a conventional inflatable lounge chair 12. Use of the apparatus 10 provides the occupant 40 with the ability to remain wet at all times without the necessity of getting into the water 38.

The materials required to manufacture the apparatus 10 are all readily available and well known to manufacturers of goods of this type. As an example, the inflatable body 58 of the chair 12 may be made of vinyl that is cut to size according to a pattern and then attached together, for example, using heat welding methods and/or adhesive. As another example, the components of the misting system 50, such as the first pump 14, the second pump 24, the first switch 34, the second switch 36, and the power supply 52 may be procured from manufacturers and wholesalers that deal in goods of that nature and integrated with the chair 12 during assembly of the apparatus 10. Other components of the apparatus 10, such as pump housings of the first pump 14 and the second pump 24, battery enclosures of the power supply 52, and/or switch enclosures of the first switch 34 and the second switch 36 of the misting system 50 may be made of plastic, for example, in an injection molding process. The power supply 52, the first pump 14, the second pump 24, the first switch 34 and the second switch 36 may all be of a waterproof design. Such a manufacturing process would require the design and use of custom molds. Other remaining components of the apparatus 10, such as the misting ports 22, the misting ports 32, the first feed tube 18, the first misting tube 20, the second feed tube 28, the second misting tube 30 of the misting system 50 and the air inflation port 13 may also be procured from manufacturers and wholesalers that deal in goods of that nature and integrated with the chair 12 during assembly of the apparatus 10.

The relatively simple design of the apparatus 10 and the materials of construction make the apparatus 10 a cost-effective design due to the relatively low material and labor costs involved. The example embodiments of the disclosed apparatus 10 would be configured and assembled as indicated in FIGS. 2-4.

The example embodiments of the disclosed apparatus 10 can be utilized by the common user in a simple and effortless manner with little or no training. After initial purchase or acquisition of the apparatus 10 it would be configured and utilized as indicated in FIG. 1.

Those skilled in the art will recognize that other styles and configurations of the disclosed apparatus 10 can be easily incorporated into the teachings of the present disclosure, and only particular configurations have been shown and described for purposes of clarity and disclosure and not by way of limitation of scope.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. An apparatus comprising:

a chair configured to float on water, wherein said chair comprises an inflatable body having a seat, a back and arm rests; and, a misting system integrated within said chair, said misting system configured to draw said water upon which said chair floats and dispense misting water, wherein said misting system comprises:

a first pump in fluid communication with said water;

a plurality of first misting ports formed in said seat;

a length of first misting tube disposed within said seat and fluidly interconnecting said first pump and said plurality of first misting ports;

a second pump in fluid communication with said water;

a plurality of second misting ports formed in said back;

a length of second misting tube disposed within said back and fluidly interconnecting said second pump and said plurality of second misting ports; and, at least one power supply in electrical communication with said first pump and said second pump, wherein said power supply is disposed within an air chamber of said inflatable body on an interior of said chair.

2. The apparatus of claim 1, wherein said misting system is configured to dispense said misting water onto a top surface of said chair.

3. The apparatus of claim 1 further comprising:

a first switch electrically interconnected between said power supply and said first pump; and, a second switch electrically interconnected between said power supply and said second pump.

4. An apparatus comprising:

a lounge chair comprising an inflatable body configured to float on water and having a seat, a back, and arm rests; and, a misting system comprising:

a first pump disposed within said seat, wherein said first pump comprises a first pump intake disposed on an exterior of a bottom surface of said seat in fluid communication with said water upon which said chair floats;

a plurality of first misting ports formed in said seat and fluidly connected to said first pump, wherein said plurality of first misting ports dispense misting water onto said seat;

a second pump disposed within said seat, wherein said second pump comprises a second pump intake disposed on said exterior of said bottom surface of said seat in fluid communication with said water;

a plurality of second misting ports formed in said back and fluidly connected to said second pump, wherein said plurality of second misting ports dispense said misting water onto said back;

a power supply in electrical communication with said first pump and said second pump;

a first switch electrically interconnected between said power supply and said first pump; and, a second switch electrically interconnected between said power supply and said second pump.

5. The apparatus of claim 4, further comprising:

a flexible first misting tube fluidly interconnected between said first pump and said plurality of first misting ports, wherein said first misting tube is routed through an interior chamber of said seat; and, a flexible second misting tube fluidly interconnected between said second pump and said plurality of second misting ports, wherein said second misting tube is routed through an interior chamber of said back.

6. The apparatus of claim 5, wherein said plurality of first misting ports extends along an outer perimeter of said seat of said chair and said plurality of second misting ports extends along an outer perimeter of said back of said chair.

* * * * *